United States Patent [19]

Clement et al.

[11] Patent Number: 4,750,296

[45] Date of Patent: Jun. 14, 1988

[54] GRINDING TOOL

[76] Inventors: Charles W. Clement, 715 S. Main St., River Falls, Wis. 54022; Robert M. George, 506 8th Ave. North, Hudson, Wis. 54016

[21] Appl. No.: 16,537

[22] Filed: Feb. 19, 1987

[51] Int. Cl.[4] ..... B24B 5/00

[52] U.S. Cl. ..... 51/132; 51/237 R; 51/215 UE; 279/1 E

[58] Field of Search ..... 51/132, 105 UG, 216 T, 51/236, 237, 171, 229, 215 UE; 279/1 E

[56] References Cited

U.S. PATENT DOCUMENTS

| | | | |
|---|---|---|---|
| 937,379 | 10/1909 | Miller | 51/132 |
| 1,141,594 | 6/1915 | Weber | 51/215 UE |
| 1,317,455 | 9/1919 | Perrine | 279/1 E |
| 1,602,135 | 10/1926 | Tryon | 51/237 X |
| 2,668,400 | 2/1954 | Bacchi | 51/229 |
| 3,125,836 | 3/1964 | Printz | 51/229 |
| 3,344,461 | 10/1967 | Floor | 51/171 X |
| 3,861,090 | 1/1975 | Lattauzio et al. | 51/229 X |
| 4,110,937 | 9/1978 | Bein | 51/229 |
| 4,164,099 | 8/1979 | Grant | 51/229 X |

FOREIGN PATENT DOCUMENTS 0004583 of 1901 United Kingdom ..... 51/215 UE

OTHER PUBLICATIONS

Article entitled "Valve Adjusting Disc Resurfacer Holders" from Goodson Manufacturing Co. 1985 catalog, p. 33.

*Primary Examiner*—Frederick R. Schmidt
*Assistant Examiner*—Shirish Desai
*Attorney, Agent, or Firm*—Dorsey & Whitney

[57] ABSTRACT

A grinding tool is provided that is especially designed for the accurate and efficient grinding of overhead camshaft motor valve clearance discs. The tool hereof includes a tool outer casing adapted for retainment in the clamping fixture of a grinding machine, a disc retaining head rotatably carried by the housing, and an axially aligned release rod shiftably carried within the retaining head and housing. In operation, the disc is retained by a lubricated force fit within a retaining head counterbore, and the grinding tool positions the disc in grinding contact with the generally planar grinding surface of a rotatable grinding wheel. The rotational mounting of the retaining head within the tool housing allows for rotation of the disc relative to the grinding wheel surface, thereby enhancing the even grinding of the disc.

11 Claims, 1 Drawing Sheet

GRINDING TOOL

TECHNICAL FIELD

The disclosed invention pertains to grinding tools. In particular, the invention pertains to a grinding tool for holding an object, such as a valve clearance disc, in grinding contact with the planar surface of a rotating grinding wheel.

BACKGROUND OF THE INVENTION

The valve actuating mechanisms of motors having overhead cam shafts often include valve adjusting discs retained by disc receiving cam followers. The valve adjusting discs are maintained in abutting contact with the motor cam shaft by the cam follower. The effective clearance between the cam follower and the cam shaft (and therefore between the respective valve and valve seat) can be adjusted by varying the width of the valve adjusting disc. Manufacturer specifications for motor valve clearances require precise measurements and close tolerances. The width of valve pad adjusting discs in an overhead cam motor must accordingly be maintained within tolerances of one-half thousandths of an inch or less.

SUMMARY OF THE INVENTION

The present invention comprises a tool for maintaining a valve adjustment disc or similar object in grinding contact with the planar surface of a rotating grinding wheel. The grinding tool hereof includes a generally cylindrical retaining head having a counterbore for receiving the disc in a lubricated force fit, and a housing for the retaining head adapted for positioning the retaining head in a position radially spaced apart from the axis of rotation of the grinding wheel. The retaining head is rotatably carried within the housing such that rotation of the grinding wheel causes rotation of the retaining head, and disc, relative to the grinding surface. A release rod is shiftably received within the housing for removal of the disc from the retaining head.

DETAILED DESCRIPTION OF THE DRAWING

Figure 1:
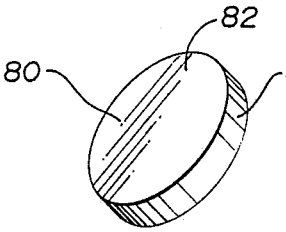
FIG. 1 is a perspective view of a typical valve adjusting disc.
Figure 2:
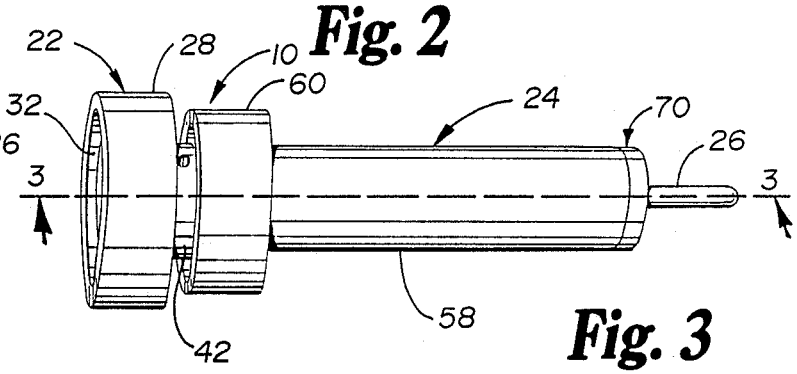
FIG. 2 is a perspective view of the grinding tool in accordance with the present invention.

Referring to the drawing, the grinding tool 10 in accordance with the present invention is depicted in conjunction with a grinding machine 12 having a rotatable grinding wheel 14. The grinding machine 12 includes a pivotal clamp fixture 16 axially shiftable by micrometer calibration device 18. The grinding wheel 14 includes a generally planar, abrasive grinding surface 20.

The grinding tool 10 broadly includes disc retaining member 22, housing 24, and release rod 26.

Figure 3:
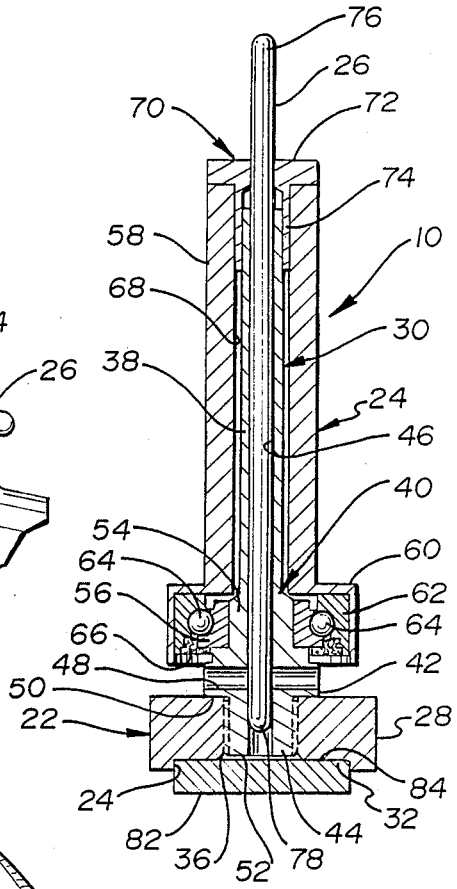
FIG. 3 is a sectional view taken along line 3—3 of FIG. 2.
Figure 4:
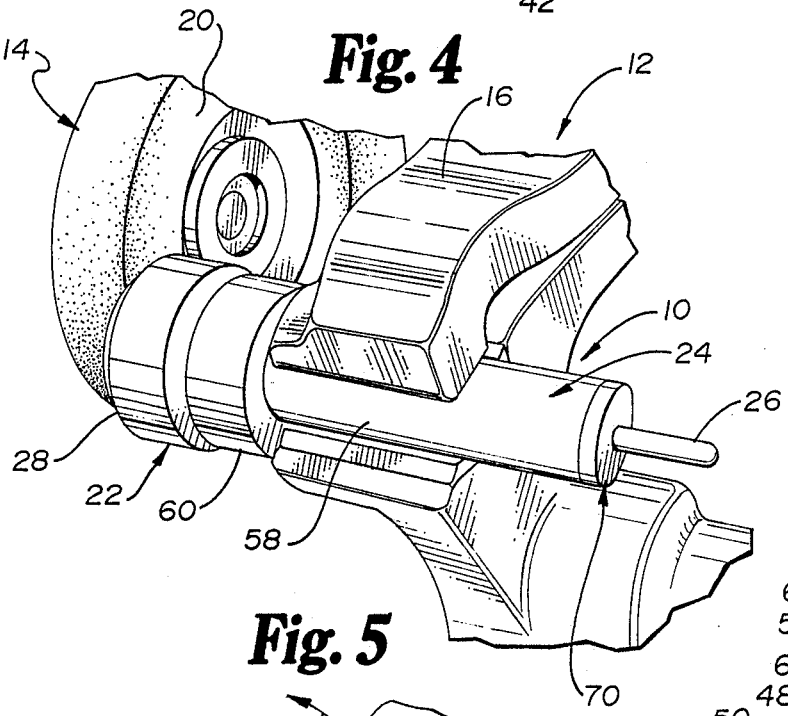
FIG. 4 is a fragmentary, perspective view of a grinding tool in accordance with the present invention, the tool being operably retained by a clamping fixture in grinding contact with an abrasive grinding wheel.

Retaining member 22 includes generally cylindrical retaining head 28 threadably received on spindle 30. The retaining head 28 includes disc receiving counterbore 32. As best seen in FIG. 3, counterbore 32 includes an outer, cylindrical portion 34, and an inner, frustoconical portion 36 of lesser diameter than the cylindrical counterbore portion 34. The counterbore 32 is symmetrically oriented about a retaining member axis of rotation defined by spindle 30.

Spindle 30 includes main body portion 38, bearing portion 40, neck portion 42, and threaded, retaining member receiving boss 44. Release rod receiving channel 46 extends along the length of spindle 30, and communicates with counterbore 32.

Spindle neck portion 42 positions the retaining member cylindrical head 28 in spaced apart relationship from the grinding tool housing 24. The neck portion 42 includes radially oriented locking channel 48 extending along the diameter of the neck portion 42, and oriented perpendicular to the release rod retaining channel 46. Spindle neck portion 42 presents abutment face 50 for restricting the rearward axially threadable shifting of retaining member cylindrical head 28. Spindle boss 44 provides counterbore bottom wall 52 spaced rearwardly from the counterbore cylindrical portion 34.

Spindle bearing portion 40 includes hub 54, and bearing race 56 fixedly carried by the hub 54. The spindle main body portion 38 comprises an elongated tubular section extending rearwardly from the hub 54. The spindle main body portion 38, spindle bearing portion 40, and spindle neck portion 42, and spindle boss 44 are preferably integrally formed.

Housing 24 includes outer casing 58 and bearing housing 60. Bearing housing 60 includes bearing housing bearing race 62, thrust bearings 64 and bearing seals 66. Outer casing 58 defines internal, spindle receiving channel 68. Housing 24 further includes rear bearing 70. Rear bearing 70 includes end cap portion 72 and bearing retaining portion 74. Retaining portion 74 is received within housing internal channel 68 in a force fit.

Release rod 26 comprises an elongated rod extending along the length of release rod channel 46, and protruding beyond the rear bearing 70 to present hand graspable portion 76. The release rod 26 is freely shiftable within the release rod channel 46, and can be removed altogether if so desired. Abutment end 78 of release rod 26 comprises the opposed end of rod 26, distal from the hand graspable end 76.

Referring to FIG. 1, a valve clearance disc 80 is depicted as a typical object to be ground. The disc 80 is generally cylindrical, having opposed circular faces 82, 84 connected by cylindrical sidewall 86. The diameter of opposed circular faces 82, 84 is just smaller than the diameter of the cylindrical portion 34 of head counterbore 32 such that the disc 80 may be received within counterbore 32 in a lubricated force fit.

In operation, the outer casing 58 of grinding tool housing 24 is fixedly retained in clamp fixture 16 of grinding machine 12. A disc to be ground 80 is placed in counterbore 32 of retaining member head 28, the counterbore 32 first being lubricated with several drops of oil or other viscous fluid. The grinding wheel 14 is mechanically, or otherwise, rotated, as indicated by arrow W in the FIG. 5, about an axis of rotation defined by grinding wheel 14.

Figure 5:
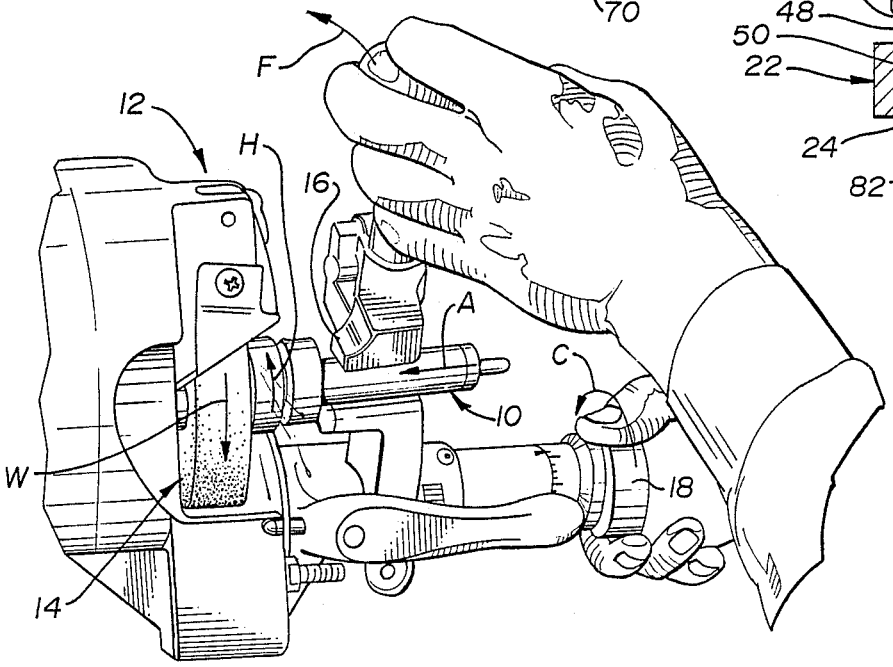
FIG. 5 is a perspective view of the grinding tool in use in a grinding machine having a rotatable grinding wheel.

Grinding tool 10, and the disk to be ground 80, are brought into contact with the generally planar surface 20 of grinding wheel 14 by rotating the clamping fixture 16 about the clamping fixture pivot axis as indicated by arrow F in FIG. 5. Calibration device 18 is next manipulated, as indicated by arrow C in FIG. 5, so as to axially shift (in the direction of arrow A in FIG. 5), clamping fixture 16, grinding tool 10, and disc 80. The disc 80 is thereby brought into grinding contact with the abrasive, planar grinding surface 20 of grinding wheel 14.

The grinding tool may be shifted back and forth along an arcuate path of travel across the grinding wheel grinding surface by shifting the clamping fixture back and forth along the path of travel indicated by arrow F of FIG. 5.

As described above, the grinding tool retaining member head 28 is rotatably mounted in the grinding tool housing 24. Contact of the disc 80 with the planar grinding surface 20 of the grinding wheel 14 will accordingly cause the disc 80, and disc retaining head 28, to rotate, in the direction of arrow H in FIG. 5, relative to the grinding tool housing 24, and grinding wheel planar surface 20. The direction of rotation of disc retaining member 22 will reverse as the grinding tool 10 is shifted over center, relative to the axis of rotation of the grinding wheel. The axis of rotation of the retaining head (and disc) is radially spaced apart from the grinding wheel axis of rotation. The rotation of the disc 80 relative to the grinding surface 20 of grinding wheel 14 will enhance the even grinding of circular face 82 of the disc 80, by ensuring that the disc 80 continually presents a new point of initial contact with the grinding wheel grinding surface.

It may be desirable in some grinding operations to temporarily lock the retaining head against rotation. For such a purpose, a rod may be inserted in locking channel 48 to manually restrict rotation of the head 38. It may also be desirable to accommodate discs of different diameters and axial widths. In this regard it will be appreciated that retaining member 22 may be threadably removed from threaded boss 44 while restricting the rotation of head 38 (as by inserting a rod in locking channel 48), and replacing the retaining member 22 with a second retaining member of different size.

The disc 80 may be easily extracted from the counterbore 32 upon the completion of grinding operations by manually shifting release rod 26 into abutting contact with circular face 84 of disc 80, thereby urging the disc 80 outwardly from the counterbore 32.

We claim:

1. An apparatus for holding an object having a generally planar surface to be ground in grinding contact with the generally planar surface of a grinding wheel, said grinding wheel being rotatable about a grinding wheel axis of rotation and said grinding wheel generally planar grinding surface oriented generally perpendicular to said grinding wheel axis of rotation, including:

a retaining member rotatable about a retaining member axis of rotation for receiving said object and holding said generally planar surface to be ground in face-to-face contact with said grinding wheel generally planar grinding surface, said retaining member including structure defining a retaining member channel generally parallel to said retaining member axis of rotation;

housing means for receiving said retaining member, said housing means adapted for positioning said retaining member axis of rotation radially spaced apart from said grinding wheel axis of rotation;

means rotatably coupling said retaining member and said housing means whereby said retaining member rotates within said housing when said grinding wheel is rotated and said planar surface to be ground is in grinding contact with said grinding wheel generally planar grinding surface, thereby enhancing the even grinding of said planar surface to be ground; and an object release rod shiftably received through said retaining member channel and selectively abutable against said object to be ground for selectively, forcibly urging said object to be ground clear of said retaining member.

2. An apparatus as claimed in claim 1, said object to be ground comprising a generally circular in cross section disc, said retaining member comprising a generally cylindrical head, said head including structure defining a counterbore for receiving said disc.

3. An apparatus as claimed in claim 2, said disc defining a disc diameter and said counterbore defining a counterbore diameter, said counterbore diameter being larger than said disc diameter so as to receive said disc in a lubricated force fit.

4. An apparatus as claimed in claim 3, said retaining member channel including a head channel defined by said head, said object release rod shiftably received through said head channel and selectively abutable against said disc for forcibly urging said disc clear of said counterbore.

5. An apparatus as claimed in claim 4, said housing means including structure defining a housing means channel aligned with said retaining member axis of rotation, said head channel aligned with said housing means channel and said disc release rod received through said housing means channel.

6. An apparatus as claimed in claim 1, said housing means including a generally tubular outer casing, said retaining member including a generally cylindrical head and an elongated spindle oriented along said retaining member axis, said spindle threadably coupled to said head and received within said tubular

7. An apparatus as claimed in claim 6, said head including structure defining a counterbore for receiving said object to be ground, said retaining member channel including an axially oriented, spindle channel defined by said spindle, said channel communicating with said counterbore, said object release rod shiftably carried within said spindle channel, said object release rod selectively abutable against said disc for forcibly urging said disc clear of said counterbore.

8. An apparatus as claimed in claim 7, said counterbore including an outer, cylindrically shaped portion defining a counterbore diameter, said disc diameter being smaller than said counterbore diameter such that said disc is received within said cylindrically shaped counterbore portion in a lubricated force fit, said counterbore further including a frusto-conical portion of smaller diameter than said counterbore diameter.

9. An apparatus as claimed in claim 8, said head including structure defining a rod receiving channel along said retaining member axis of rotation, said rod receiving channel oriented in fluid communicating relationship with said counterbore frusto-conical portion.

10. An apparatus as claimed in claim 6, said spindle including a boss received by said head and a neck portion supporting said boss and said head in spaced apart relationship with said housing means.

11. An apparatus as claimed in claim 10, said neck including structure defining a locking channel orthogonally oriented with respect to said retaining member axis of rotation for locking the rotation of said retaining member with respect to said housing means.

* * * * *

UNITED STATES PATENT AND TRADEMARK OFFICE

CERTIFICATE OF CORRECTION

PATENT NO. : 4,750,296

DATED : June 14, 1988

INVENTOR(S) : Charles W. Clement and Robert M. George

It is certified that error appears in the above-identified patent and that said Letters Patent is hereby corrected as shown below:

Column 4, line 37, at the end of claim 6, after the word "tubular", insert --outer casing.--

Signed and Sealed this

Eighth Day of November, 1988

*Attest:*

DONALD J. QUIGG

*Attesting Officer*

*Commissioner of Patents and Trademarks*